US008574142B2

(12) United States Patent
Broering et al.

(10) Patent No.: US 8,574,142 B2
(45) Date of Patent: Nov. 5, 2013

(54) APPARATUS FOR INSERTING A FIRST FOLDED FILM WITHIN A SECOND C-FOLDED FILM

(75) Inventors: Shaun T. Broering, Fort Thomas, KY (US); Matthew W. Waldron, Hamilton, OH (US); Angelli Sue Denmon, Hamilton, OH (US)

(73) Assignee: The Glad Products Company, Oakland, CA (US)

( * ) Notice: Subject to any disclaimer, the term of this patent is extended or adjusted under 35 U.S.C. 154(b) by 157 days.

(21) Appl. No.: 13/225,930

(22) Filed: Sep. 6, 2011

(65) Prior Publication Data

US 2013/0059712 A1 Mar. 7, 2013

(51) Int. Cl.
*B31B 49/04* (2006.01)

(52) U.S. Cl.
USPC ..... 493/383; 493/331; 493/405

(58) Field of Classification Search
USPC ..... 493/379, 383, 474, 334, 406, 225, 390, 493/220, 381, 243, 344, 458
See application file for complete search history.

(56) References Cited

U.S. PATENT DOCUMENTS

| | | | |
|---|---|---|---|
| 3,857,144 | A | 12/1974 | Bustin |
| 4,205,504 | A | 6/1980 | Gregoire et al. |
| 4,273,549 | A | 6/1981 | Pezzana et al. |
| 4,302,495 | A | 11/1981 | Marra |
| 4,930,905 | A | 6/1990 | Sharps, Jr. |
| 5,100,721 | A | 3/1992 | Akao |
| 5,381,644 | A | 1/1995 | Di Bernardo |
| 5,382,461 | A | 1/1995 | Wu |
| 5,422,172 | A | 6/1995 | Wu |
| 5,518,801 | A | 5/1996 | Chappell et al. |
| 5,851,937 | A | 12/1998 | Wu |
| 5,861,074 | A | 1/1999 | Wu |
| 5,865,926 | A | 2/1999 | Wu et al. |
| 6,013,151 | A | 1/2000 | Wu et al. |
| 6,214,147 | B1 | 4/2001 | Mortellite et al. |
| 6,265,045 | B1 | 7/2001 | Mushaben |
| 6,740,184 | B2 | 5/2004 | Mortellite et al. |
| 6,742,318 | B2 | 6/2004 | Goldstein |
| 2004/0134923 | A1 | 7/2004 | Aquino et al. |
| 2006/0093766 | A1 | 5/2006 | Savicki et al. |
| 2008/0124461 | A1 | 5/2008 | Leener et al. |
| 2009/0029114 | A1 | 1/2009 | Cancio et al. |
| 2009/0197750 | A1 * | 8/2009 | Beckmann et al. ..... 493/11 |
| 2011/0114249 | A1 | 5/2011 | Rasmussen |
| 2011/0117307 | A1 | 5/2011 | Fraser et al. |

FOREIGN PATENT DOCUMENTS

| | | |
|---|---|---|
| WO | WO2010015512 | 2/2010 |
| WO | WO2010128124 | 11/2010 |

OTHER PUBLICATIONS

International Search Report, mailed Nov. 26, 2012, from counterpart PCT/US 12/53739, filing date Sep. 5, 2012.

* cited by examiner

*Primary Examiner* — Alexandra Elve
*Assistant Examiner* — Adam Moon
(74) *Attorney, Agent, or Firm* — Thomas C. Feix

(57) ABSTRACT

Apparatus for inserting a folded film into another folded film include combining the films without unfolding or folding either of the folded films. In particular, one or more implementations include a spreader bar configured to separate layers of a first folded film. Additionally, the apparatus can include one or more orientation rollers configured to direct a second film between the separated layers of the first folded film. Furthermore, the apparatus can include a direction change bar configured to change the direction a travel of the second film while the second film is positioned between the layers of the first folded film.

20 Claims, 6 Drawing Sheets

APPARATUS FOR INSERTING A FIRST FOLDED FILM WITHIN A SECOND C-FOLDED FILM

BACKGROUND OF THE INVENTION

1. The Field of the Invention

The present invention relates generally to webs and films. Specifically, the invention relates to methods of inserting one c-folded film or web in another c-folded film or web.

2. Background and Relevant Art

Thermoplastic films are a common component in various commercial and consumer products. For example, grocery bags, trash bags, sacks, and packaging materials are products that are commonly made from thermoplastic films. Additionally, feminine hygiene products, baby diapers, adult incontinence products, and many other products include thermoplastic films to one extent or another.

Thermoplastic films have a variety of different strength parameters that manufacturers of products incorporating a thermoplastic film component may attempt to manipulate to ensure that the film is suitable for use its intended use. For example, manufacturers may attempt to increase or otherwise control the tensile strength of a thermoplastic film. The tensile strength of a thermoplastic film is the maximum stress that a film can withstand while being stretched before it fails. Another strength parameter that manufacturers may want to increase or otherwise control is tear resistance. The tear resistance of a thermoplastic film is the amount of force required to propagate or enlarge a tear that has already been created in a film. Still further, a manufacturer may want to increase or otherwise control a film's impact resistance.

When forming various products from thermoplastic films, a manufacturer may fold the thermoplastic film in half (or otherwise create a folded film) and use the folded film to produce a product. For example, the manufacturer may use a folded film to create a bag. In particular, the manufacturer may seal the sides of the folded film adjacent the fold. The sealed sides and the bottom fold may form the three joined sides of a bag.

Unfortunately, conventional methods for combining folded films have various disadvantages that lead to undesirable conditions. For example, conventional methods for combining folded films may require significant machine width to handle wide webs and machine direction length to fold the films. Furthermore, conventional methods for combining folded films may lead to web handling and wrinkle issues that are undesirable.

Accordingly, there are a number of considerations to be made in thermoplastic films and manufacturing methods.

BRIEF SUMMARY OF THE INVENTION

Implementations of the present invention provide benefits and/or solve one or more problems in the art with apparatus for inserting a folded film into another folded film without the need to first combine unfolded films and then fold them together. Furthermore, one or more implementations provide apparatus for inserting a folded film into another folded film without any folding or unfolding during the insertion process. Thus, one or more implementations can result in conservation of floor space in manufacturing thereby resulting in lowered capital costs.

For example, an implementation of an apparatus for inserting a first folded film into a second folded film can include a spreader bar extending in a first direction. The apparatus can also include one or more orientation rollers extending in a second direction that is transverse to the first direction. The apparatus can further include a first direction change bar positioned down line relative to the spreader bar. The first direction change bar can extend in a third direction that is oriented at an acute angle relative to the first direction.

Additionally, another implementation of an apparatus for inserting a first folded film into a second folded film can include a spreader bar configured to separate layers of a first folded film. Also, the apparatus can include at least one roller configured to direct a second film between the separated layers of the first folded film. Furthermore, the apparatus can include a first direction change bar configured to change a direction a travel of the second film while the second film is positioned between the layers of the first folded film.

In addition to the foregoing, yet another implementation of an apparatus for inserting a first folded film into a second folded film can include a spreader bar extending in a first direction. The spreader bar can be configured to separate layers of a first folded film. Additionally, the apparatus can include one or more rollers configured to direct a first folded film across the spreader bar in a first direction of travel. Still further, the apparatus can include one or more orientation rollers extending in a second direction that is perpendicular to the first direction. The one or more orientation rollers can be configured to direct a second film between the separated layers of the first folded film in a second direction of travel. The apparatus can also include a first direction change bar. The first direction change bar can extend in a third direction that is oriented at an acute angle relative to the first direction. The first direction change bar can be configured to redirect the second film from the second direction of travel to the first direction of travel while the second film is positioned between the layers of the first folded film.

Additional features and advantages of exemplary embodiments of the present invention will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims, or may be learned by the practice of such exemplary embodiments as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
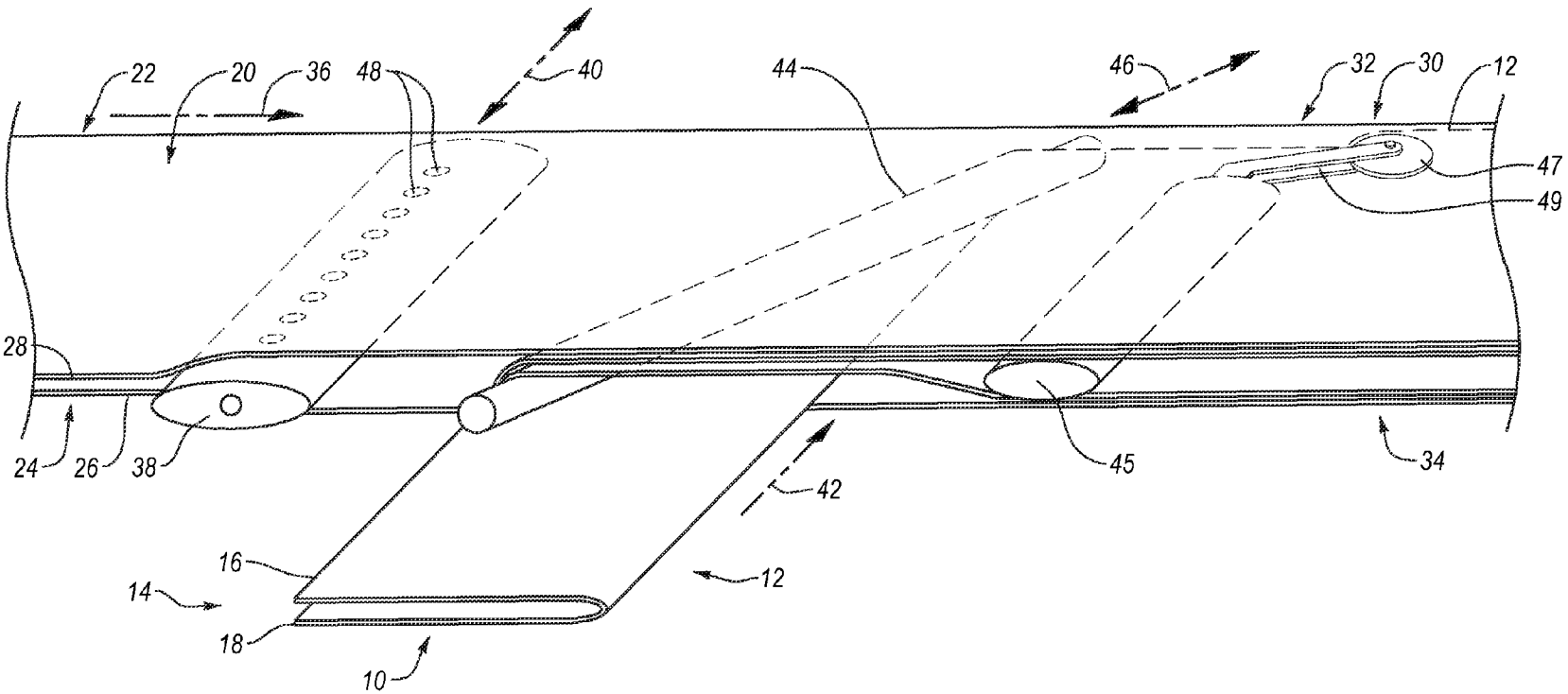
FIG. 1 illustrates a process and apparatus for inserting a folded film into another folded film in accordance with an implementation of the present invention.

One or more implementations of the present invention include apparatus for inserting a folded film into another folded film without the need to first combine unfolded films and then fold them together. Furthermore, one or more implementations provide apparatus for inserting a folded film into another folded film without any folding or unfolding during the insertion process. Thus, one or more implementations can result in conservation of floor space in manufacturing thereby resulting in lowered capital costs.

Additionally, one or more implementations provide efficient systems and methods for combining folded films. The reduction in process steps by eliminating the need to process unfolded webs can allow for increased reliability and a reduction or elimination of wrinkles in resulting product(s). Furthermore, one or more implementations can combine folded films effectively and efficiently without compromising important material properties of the product, such as tear and puncture resistance.

In addition to the foregoing, systems and methods of one or more implementations allow the folded films to undergo different cold formation transformations prior to being combined. For example, one or more implementations allow folded films to undergo different incremental stretching or other processing that can increase the surface area and/or modify the physical properties of the films. After being combined, the folded films can be laminated together to form a multi-layered film with the same or better performance with less material than a mono-layer or co-extruded multi-layer film.

Film Materials

As a preliminary matter, implementations of the present invention are described herein primarily with reference to processing and combining of thermoplastic films or webs. One will appreciate, however, that thermoplastic films or webs, are only one type of "structure" which a user may process using the components, systems, and methods described herein. For example, a user can use implementations of the present invention to insert one folded layer within another folded layer of not only thermoplastic films, as such, but also paper, woven or non woven fabrics, or other structures. Reference herein, therefore, to thermoplastic films or webs, as such, is primarily for convenience in description.

The thermoplastic material of the films of one or more implementations can include, but are not limited to, thermoplastic polyolefins, including polyethylene and copolymers thereof and polypropylene and copolymers thereof. The olefin based polymers can include the most common ethylene or propylene based polymers such as polyethylene, polypropylene, and copolymers such as ethylene vinylacetate (EVA), ethylene methyl acrylate (EMA) and ethylene acrylic acid (EAA), or blends of such polyolefins.

Other examples of polymers suitable for use as films in accordance with the present invention include elastomeric polymers. Suitable elastomeric polymers may also be biodegradable or environmentally degradable. Suitable elastomeric polymers for the film include poly(ethylene-butene), poly(ethylene-hexene), poly(ethylene-octene), poly(ethylene-propylene), poly(styrene-butadiene-styrene), poly(styrene-isoprene-styrene), poly(styrene-ethylene-butylene-styrene), poly(ester-ether), poly(ether-amide), poly(ethylene-vinylacetate), poly(ethylene-methylacrylate), poly(ethylene-acrylic acid), poly(ethylene butylacrylate), polyurethane, poly(ethylene-propylene-diene), ethylene-propylene rubber.

Indeed, implementations of the present invention can include any flexible or pliable thermoplastic material which may be formed or drawn into a web or film. Furthermore, the thermoplastic materials may include a single layer or multiple layers. Examples of multi-layered films suitable for use with one or more implementations of the present invention include coextruded multi-layered films, multiple films continuously laminated together, and multiple films partially or discontinuously laminated together. The thermoplastic material may be opaque, transparent, translucent, or tinted. Furthermore, the thermoplastic material may be gas permeable or impermeable.

As used herein, the term "flexible" refers to materials that are capable of being flexed or bent, especially repeatedly, such that they are pliant and yieldable in response to externally applied forces. Accordingly, "flexible" is substantially opposite in meaning to the terms inflexible, rigid, or unyielding. Materials and structures that are flexible, therefore, may be altered in shape and structure to accommodate external forces and to conform to the shape of objects brought into contact with them without losing their integrity. In accordance with further prior art materials, web materials are provided which exhibit an "elastic-like" behavior in the direction of applied strain without the use of added traditional elastic. As used herein, the term "elastic-like" describes the behavior of web materials which when subjected to an applied strain, the web materials extend in the direction of applied strain, and when the applied strain is released the web materials return, to a degree, to their pre-strained condition.

In addition to the foregoing, one will appreciate in light of the disclosure herein that manufacturers may form the films or webs to be used with the present invention using a wide variety of techniques. For example, a manufacturer can form the films using conventional flat or cast extrusion or co-extrusion to produce mono-layer, bi-layer, or multi-layer films. Alternatively, a manufacturer can form the films using suitable processes, such as, a blown film process to produce mono-layer, bi-layer, or multi-layer films. If desired for a given end use, the manufacturer can orient the films by trapped bubble, tenterframe, or other suitable process.

Additionally, the manufacturer can optionally anneal the films thereafter.

In one or more implementations, the films of the present invention are blown film, or cast film. Blown film and cast film is formed by extrusion. The extruder used can be a conventional one using a die, which will provide the desired gauge. Some useful extruders are described in U.S. Pat. Nos. 4,814,135; 4,857,600; 5,076,988; 5,153,382; each of which is incorporated herein by reference. Examples of various extruders, which can be used in producing the films to be used with the present invention, can be a single screw type modified with a blown film die, an air ring, and continuous take off equipment.

In a blown film process, the die can be an upright cylinder with an annular opening. Rollers can pull molten plastic upward away from the die. An air-ring can cool the film as the film travels upwards. An air outlet can force compressed air into the center of the extruded annular profile, creating a bubble. The air can expand the extruded circular cross section by a multiple of the die diameter. This ratio is called the "blow-up ratio."

Films may be formed into folded films or webs such as c-folded films and webs or u-folded films or webs. Such folded films and webs may be formed by collapsing and then cutting an annular tube of film formed using a blown film process. In particular, the annular tube can be cut in half to form two folded films (which are mirror images of each other). In another processes, a folded film may be formed by the mechanical folding of a film.

The films of one or more implementations of the present invention can have a starting gauge between about 0.1 mils to about 20 mils, suitably from about 0.2 mils to about 4 mils, suitably in the range of about 0.3 mils to about 2 mils, suitably from about 0.6 mils to about 1.25 mils, suitably from about 0.9 mils to about 1.1 mils, suitably from about 0.3 mils to about 0.7 mils, and suitably from about 0.4 mils and about 0.6 mils. In further implementations, the starting gauge of the films may be greater than about 20 mils. Additionally, the starting gauge of films of one or more implementations of the present invention may not be uniform. Thus, the starting gauge of films of one or more implementations may vary along the length and/or width of the film.

It may be useful and beneficial to combine two or more folded films by inserting one folded film into another folded film such that the folded edges of the composed films coincide and the open edges of the folded films coincide. Such films can be used to form multi-layered bags with no seam along the bottom of the bag. Instead of a seam, the fold of the films can form the bottom of the bag.

Referring now to the Figures, FIG. 1 illustrates one exemplary process and apparatus for inserting a folded film into another folded film in accordance with an implementation of the present invention. In particular, FIG. 1 illustrates an insertion process that inserts one folded film 10 into another folded film 20 and produces a multi-layer composition 30. As illustrated, the folded film 10 can comprise a folded edge 12, an open edge 14, a first half 16, and a second half 18. Similarly, the folded film 20 can comprise a folded edge 22, an open edge 24, a first half 26, and a second half 28. Thus, as shown, each of the folded films 10, 20 can comprise a "c," "j," or "u" configuration. As such, the folded films 10, 20 may be referred to herein as c-folded, j-folded films, or u-folded films. C-folded films can comprise films that are symmetrical about their folded edge, while j- or u-folded films can comprise films that are not symmetrical about their folded edge (i.e., one of the halves extend farther than the other).

FIG. 1 also depicts the resulting multi-layer composite folded film 30. The resulting multi-layer composite folded film 30 is comprised of folded film 10 which is inserted within folded film 20. In particular, the folded film 10 lies between the first half 26 and the half 28 of folded film 20. The resulting multi-layer composite folded film 30 has a folded edge 32 and an open edge 34. The folded edges 12 and 22 of folded films 10 and 20 coincide with the folded edge 32 of the resulting multi-layer composite folded film 30. Correspondingly, the open edges 14 and 24 of folded films 10 and 20 coincide with the open edge 34 of the resultant multi-layer composite folded film 30.

As explained in greater detail below, the folded film insertion processes of the present invention can produce a multi-layer composite folded film which may comprise properties of both folded film 10 and folded film 20. Such combination of properties of two composed folded films may have beneficial effects in the resulting composite and for products, such as trash or food bags, which are manufactured with the composite folded films. Additionally, the processes and apparatus disclosed herein may provide benefits in the manufacturing process for producing a composite folded film by reducing the time, floor space, and complexity of inserting one folded film into another folded film. The reduction in the time, floor space, and complexity for inserting one folded film into another folded film, in turn, can result in efficiencies and cost savings for the production of films and products.

To produce the multi-layer composite folded film 30, a manufacturer can advance the folded film 20 in a first direction of travel 36. In one or more implementations the first direction of travel 36 may be parallel to a machine direction, or in other words, the direction in which the folded film 20 was extruded. While traveling in the first direction of travel 36, the manufacturer can separate the first half 26 from the second half 28 of the folded film 20. For example, the folded film 20 can pass about a spreader bar 38. The spreader bar 38 can open the folded film 20. For example, FIG. 1 illustrates that the spreader bar 38 can separate the first half 26 from the second half 28 of the folded film 20, thereby creating a space between the first and second halves 26, 28. In particular, the first half 26 of the folded film 20 can pass on one side of the spreader bar 38 and the second half 26 of the folded film 20 can pass on an opposing side of the spreader bar 38.

The spreader bar 38 can be made of cast and/or machined metal, such as, steel, aluminum, or any other suitable material. Optionally, the spreader bar 38 can be coated with a material such as a rubber or urethane. Still further, the spreader bar 38 can optionally have an air bearing assist or plasma coating to reduce friction. The spreader bar 38 can extend in a direction 40. In one or more implementations, the direction 40 can be transverse or perpendicular to the first direction of travel 36. Thus, in one or more implementations the spreader bar 38 can extend in a direction transverse to the machine direction. The spreader bar 38 can have any configuration that allows for separating of the first and second halves 26, 28 of the folded film 20. For instance, as shown by FIG. 1 the spreader bar 38 can have tapered leading edge. In alternative implementations, the spreader bar 38 can have a cylindrical or other shape.

FIG. 1 further illustrates that a manufacturer can advance the folded film 10 in a second direction of travel 42. The second direction of travel 42 can be non-parallel to the first direction of travel 36. For example, in one or more implementations the second direction of travel 42 can be transverse or perpendicular to the first direction of travel 36. The manufacturer can further insert the folded film 10 between the separated halves 26, 28 of folded film 20. For example, the manufacturer can advance the folded film 10 in the second direction of travel 42 between the first half 26 and the second half 28 of folded film 20.

Once within the folded film 20, the manufacturer can redirect the folded film 10 from the second direction of travel 42 to the first direction of travel 36. In particular, the folded film 10 can change directions from the second direction of travel 42 to the first direction of travel 36 while between the first and second layers 26, 28 of the folded film 20. For example, the folded film 10 can pass about a direction change bar or roller 44. The direction change bar 44 can change the direction of travel of the folded film 10. More specifically, the folded film 10 can pass initially on a first side of the direction change bar 44 and then pass about the direction change bar 44 so the folded film 10 leaves a second opposing side of the direction change bar 44.

One will appreciate in light of the disclosure herein that the direction change bar 44 can comprise a number of different configurations. For example, FIG. 1 illustrates that the direction change bar 44 can comprise a cylinder. In alternative implementations, the direction change bar 44 may be a flat bar with a tapered edge, or may be a roller with a rolling direction to accommodate the direction of travel of folded film 10. Thus, in the implementation shown in FIG. 1, the direction change bar 44 can rotate in a clockwise direction. The direction change bar 44 can be made of cast and/or machined metal, such as, steel, aluminum, or any other suitable material. Optionally, the direction change bar 44 can be coated with a material such as a rubber or urethane. Still further, the direction change bar 44 can optionally have an air bearing assist or plasma coating to reduce friction.

FIG. 1 illustrates that the direction change bar 44 can reside in plane with the spreader bar 38. The in-plane configuration of the spreader bar 38 and the direction change bar 44 can allow the direction change bar 44 to change the direction of the folded film 10 while within the folded film 20. FIG. 1 further illustrates that the direction change bar 44 can extend in a direction 46. The direction 46 can extend at an acute angle relative to direction 40. For example, the direction 46 can extend at an angle of 45 degrees relative to direction 40. In other words, the direction change bar 44 can extend at an angle of 45 degrees relative to the spreader bar 38. Thus, as folded film 10 passes over direction change bar 44, direction change bar 44 can effect a change in direction of travel of folded film 10 of 90 degrees. In other words, after passing about the direction change bar 44, folded film 10 can travel in a direction perpendicular to the second direction of travel 42.

After folded film 10 passes over direction change bar 44, folded film 10 is then situated between the first and second layers 26, 28 of folded film 20 (i.e., folded film 10 has been inserted into folded film 20) resulting in multi-layer composite folded film 30. As previously mentioned, multi-layer composite folded film 30 has a folded edge 32 and an open edge 34. The folded edges 12 and 22 of folded films 10, 20 coincide with the folded edge 32 of the resulting multi-layer composite folded film 30. Correspondingly, the open edges 14 and 24 of folded films 10, 20 coincide with the open edge 34 of the resultant multi-layer composite folded film 30.

One or more implementations can further include an applicator that applies an additive to one or more of the halves 16, 18, 26, 28 of the folded films 10, 20. For example, FIG. 1 illustrates that the spreader bar 38 can have an integrated applicator. The integrated applicator can include a plurality of openings 48 that dispense or spray an additive on the inside surface of the folded film 20 as the folded film 20 passes about the spreader bar 38. As explained in greater detail below, in alternative implementations a separate applicator can reside between the spreader bar 38 and the direction change bar 44.

In any event, the applicator can apply an additive to one or more of the folded films 10, 20. Such additives can comprise glues, adhesives, oils, fragrances, or other additives. For example, in one or more implementations the applicator can apply glue or another adhesive to the inner surface of folded film 20 and/or the outer surface of folded film 10. The glue can then adhere or laminate the inner surface of the folded film 20 to the outer surface of the folded film 10 after the folded film 10 is inserted within the folded film 20.

FIG. 1 illustrates a c-folded film 10 being inserted within another c-folded film 20. In one or more implementations the process and apparatus described in relation to FIG. 1 can be duplicated to combine three or more folded films or one or more folded films with one or more mono-layered film. For example, in one or more implementations another spreader bar similar to the spreader bar 38 can separate the first halves 16, 26 from the second halves 18, 28 of the multi-layer composite folded film 30. A manufacturer can then direct an additional film (either a mono-layer film or another folded film) in the second direction of travel 42. The process can then include inserting the additional film between the first halves 16, 26 and the second halves 18, 28 of the folded films 10, 20. Once within the first and second halves, the process can include redirecting the third film from the second direction of travel 42 into the first direction of travel 36. In particular, the third film can pass about a direction change bar similar to direction change bar 44.

In addition to the foregoing, one or more implementations can further include abutting the folded edge 12 of the folded film 10 against the folded edge 22 of the folded film 20. For example, FIG. 1 shows that once the folded film 10 is inserted within the folded film 20, the manufacturer can separate the first half 16 from the second half 18 of the folded film 10. For example, the folded film 10 can pass about a crease bar 45. The crease bar 45can open the folded film 10. For example, FIG. 1 illustrates that the crease bar 45can separate the first half 16 from the second half 18 of the folded film 10, thereby creating a space between the first and second halves 16, 18. In particular, the first half 16 of the folded film 10 can pass on one side of the crease bar 45 and the second half 16 of the folded film 10 can pass on an opposing side of the crease bar 45.

The crease bar 45 can be made of cast and/or machined metal, such as, steel, aluminum, or any other suitable material. Optionally, the crease bar 45 can be coated with a material such as a rubber or urethane. Still further, the crease bar 45 can optionally have an air bearing assist or plasma coating to reduce friction. The crease bar 45 can extend in a direction 40. The crease bar 45 can have any configuration that allows for separating of the first and second halves 16, 18 of the folded film 10. For instance, as shown by FIG. 1, the crease bar 45 can have tapered leading edge. In alternative implementations, the crease bar 45 can have a cylindrical or other shape.

The end of the crease bar 45 can include a wheel 47. In one or more implementations an arm 49 can position the wheel 47 down line from the crease bar 45. In alternative implementations, the wheel 47 can be in line with the crease bar 45 or on a separate bar down line from the crease bar 45. In any event, the wheel 47 can reside between the first and second halves 16, 18 of the folded film 10 separated by the crease bar 45. The wheel 47 can rotate and urge the folded edge 12 of the folded film 10 toward the folded edge 22 of the folded film 20. For example, in one or more implementations the wheel 47 can push or otherwise position the folded edge 12 of the folded film 10 against the folded edge 22 of the folded film 20.

Optionally, the wheel 47 can be coated with a material such as a rubber or urethane. Still further, the wheel 47 can optionally have an air bearing assist or plasma coating to reduce friction. In one or more implementations the wheel 47 can be configured to ensure that it does not rip or otherwise tear either of the folded films 10, 29. For example, the wheel 47 can be spring-loaded. Alternatively, or additionally, sensors can monitor the force the wheel 47 exerts on the folded films 10, 20. An actuator can automatically adjust one or more of the position of the wheel 47, the speed of the wheel 47, or other parameters to in response to the sensors to reduce the likelihood or prevent the wheel 47 from damaging the films.

FIG. 1 depicts an implementation wherein folded film 10 and folded film 20 arrive at the process and apparatus in perpendicular directions. In order to reduce manufacturing space, in one or more implementations folded film 10 and folded film 20 can arrive in directions other than perpendicular directions. For example, FIG. 2 illustrates an apparatus and method for inserting a folded film within another folded film in which the folded films 10, 20 both begin the process by advancing in the first direction of travel 36.

Figure 2:
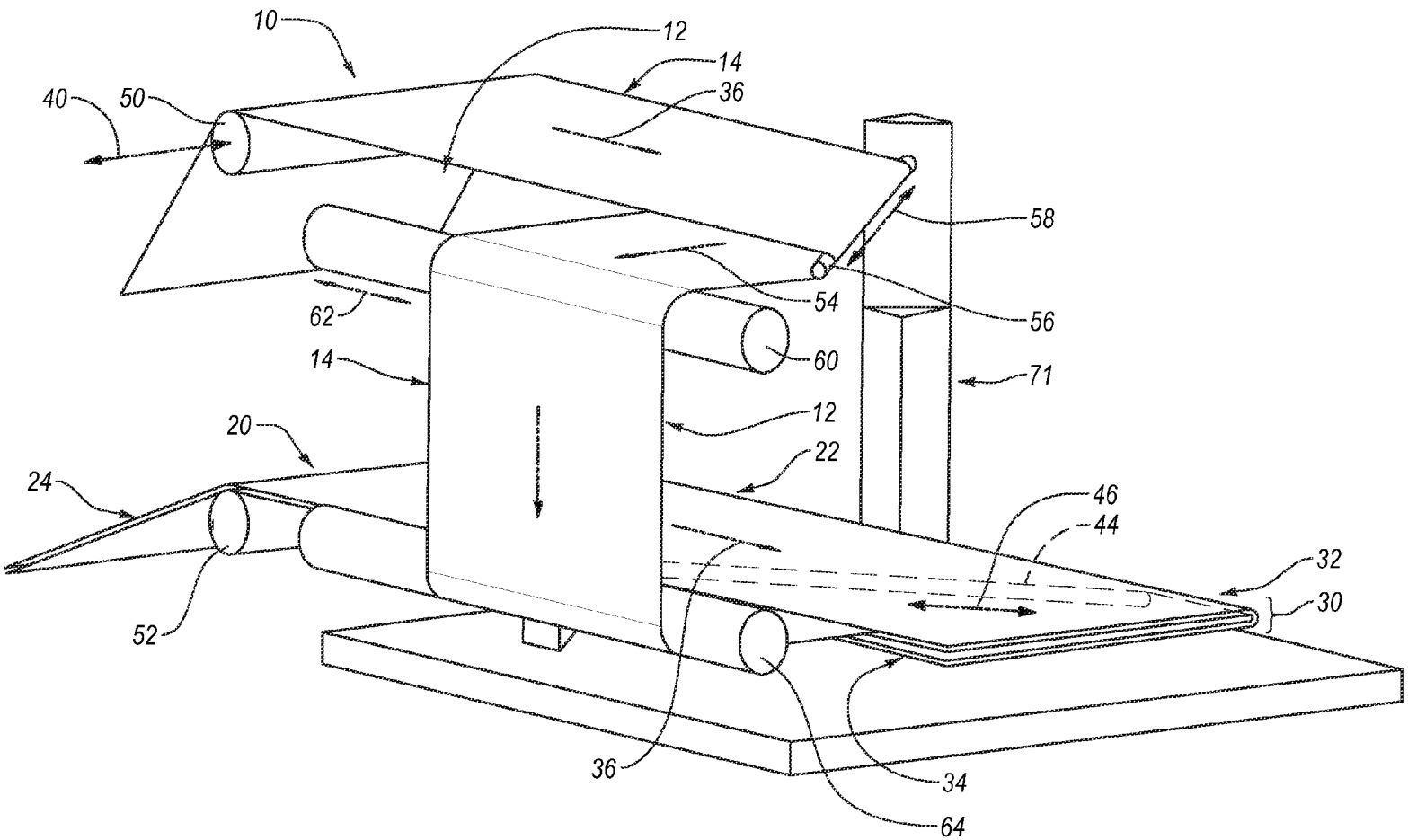
FIG. 2 illustrates another process and apparatus for inserting a folded film into another folded film in accordance with an implementation of the present invention.

As shown by FIG. 2, a guide roller 50 can direct the folded film 10 in the first direction of travel 36. Similarly, an additional guide roller 52 can direct the folded film 20 in the first direction of travel 36. Each of the guide rollers 50, 52 can extend in direction 40. The guide rollers 50, 52 can each have a generally cylindrical shape. The guide rollers 50 and 52 may be made of cast and/or machined metal, such as, steel, aluminum, or any other suitable material. The rollers 50 and 52 can rotate in a corresponding direction about parallel axes of rotation.

Guide roller 50, and thus folded film 10, can reside out of plane with guide roller 52, and thus folded film 20. For example, FIG. 2 illustrates that guide roller 50 can reside vertically above guide roller 52. One will appreciate that running folded films 10, 20 vertically on top of each other can reduce the foot print of the folded film combining apparatus. In alternative implementations, the guide roller 50, and thus folded film 10, can reside in the same plane with guide roller 52, and thus folded film 20.

After passing from the roller 50, the manufacturer can redirect the folded film 10 from the first direction of travel 36 to a third direction of travel 54. In particular, the folded film 10 can change directions from the first direction of travel 36 to the third direction of travel 54 by passing about a direction change bar or roller 56. The direction change bar 56 can change the direction of travel of the folded film 10 in a manner similar to that of direction change bar 44. Furthermore, direction change bar 56 can have a similar configuration to that of direction change bar 44. More specifically, folded film 10 can pass initially on a first side of the direction change bar 56 and then pass about the direction change bar 56 so folded film 10 leaves a second opposing side of the direction change bar 56.

FIG. 2 illustrates that the direction change bar 56 can reside in plane with the guide roller 50. Furthermore, the direction change bar 56 can reside out of plane with the direction change bar 44. For example, FIG. 2 illustrates that the direction change bar 56 can reside vertically above direction change bar 44.

FIG. 2 further illustrates that the direction change bar 56 can extend in a direction 58. The direction 58 can extend at an acute angle relative to the direction 40. For example, the direction 58 can extend at an angle of 45 degrees relative to the direction 40. In other words, the direction change bar 56 can extend at an angle of 45 degrees relative to the guide roller 50. In one or more implementations, the direction change bar 56 can extend in a direction 58 perpendicular to the direction 46 in which the direction change bar 44 extends. In any event, as folded film 10 passes over direction change bar 56, direction change bar 56 can effect a change in direction of travel of folded film 10 such that folded film 10 after passing about the direction change bar 56 travels in a direction perpendicular to the second direction of travel 36.

One or more orientation rollers can then direct the folded film 10 to the same plane as the folded film 20. For example, FIG. 2 illustrates that an orientation roller 60 can redirect the folded film 10 from a plane to a perpendicular plane. In particular, orientation roller 60 can redirect the folded film 10 from traveling in a horizontal plane to a vertical plane. The orientation roller 60 can extend in a direction 62 perpendicular to direction 40. Additionally, the orientation roller 60 can lie in the same plane as the direction change bar 56.

After passing from the orientation roller 60, the folded film 10 can pass about another orientation roller 64. Orientation roller 64 can redirect the folded film 10 from a plane to a perpendicular plane. In particular, orientation roller 64 can redirect the folded film 10 from traveling in a vertical plane to a horizontal plane. As shown by FIG. 2, orientation roller 64 can direct the folded film 10 into the second direction of travel 42. The orientation roller 64 can extend in direction 62. Additionally, the orientation roller 64 can lie in the same plane as the direction change bar 44.

The manufacturer can then insert the folded film 10 between the separated halves 26, 28 of folded film 20 as described above. Once within the folded film 20, the manufacturer can redirect the folded film 10 from the second direction of travel 42 to the first direction of travel 36. In particular, folded film 10 can pass about the direction change bar or roller 44 as described above. After folded film 10 passes over direction change bar 44, folded film 10 is then situated between the first and second layers 26, 28 of folded film 20 (i.e., folded film 10 has been inserted into folded film 20) resulting in multi-layer composite folded film 30.

As shown by FIG. 2, the folded edge 12 and open edge 14 of folded film 10 can change sides within the apparatus and during the process. As folded film 10 travels in the first direction of travel 36, folded edge 12 is at the "front" of FIG. 2 and open edge 14 is at the "back" of FIG. 2. As folded film 20, on the other hand, travels in the first direction of travel 36, folded edge 22 is at the "back" of FIG. 2 and open edge 24 is at the "front" of FIG. 2. Thus, the folded film 10 and the folded film 20 can enter the apparatus in opposing orientations. By passing about orientation rollers 60, 64 and direction change bar 44, the open edge 14 of folded film 10 can change to the "front" of FIG. 2 and the folded edge 12 can change to the "back" of FIG. 2. As multi-layer composite folded film 30 emerges from the apparatus and process, folded edge 12 of folded film 10 is coincident with folded edge 22 of folded film 20 and open edge 14 of folded film 10 is coincident with open edge 24 of folded film 20.

The system and devices of FIG. 2 do not include the crease bar 45 and wheel 47. One will appreciate in light of the disclosure herein, that the crease bar 45 and wheel 47 can be added to the systems and devices of FIG. 2 and/or any of the other devices, systems, and methods described herein. For example, in one or more implementations the system and devices of FIG. 2 can include a crease bar 45 and wheel 47 positioned down line from the direction change bar 44.

Figure 3:
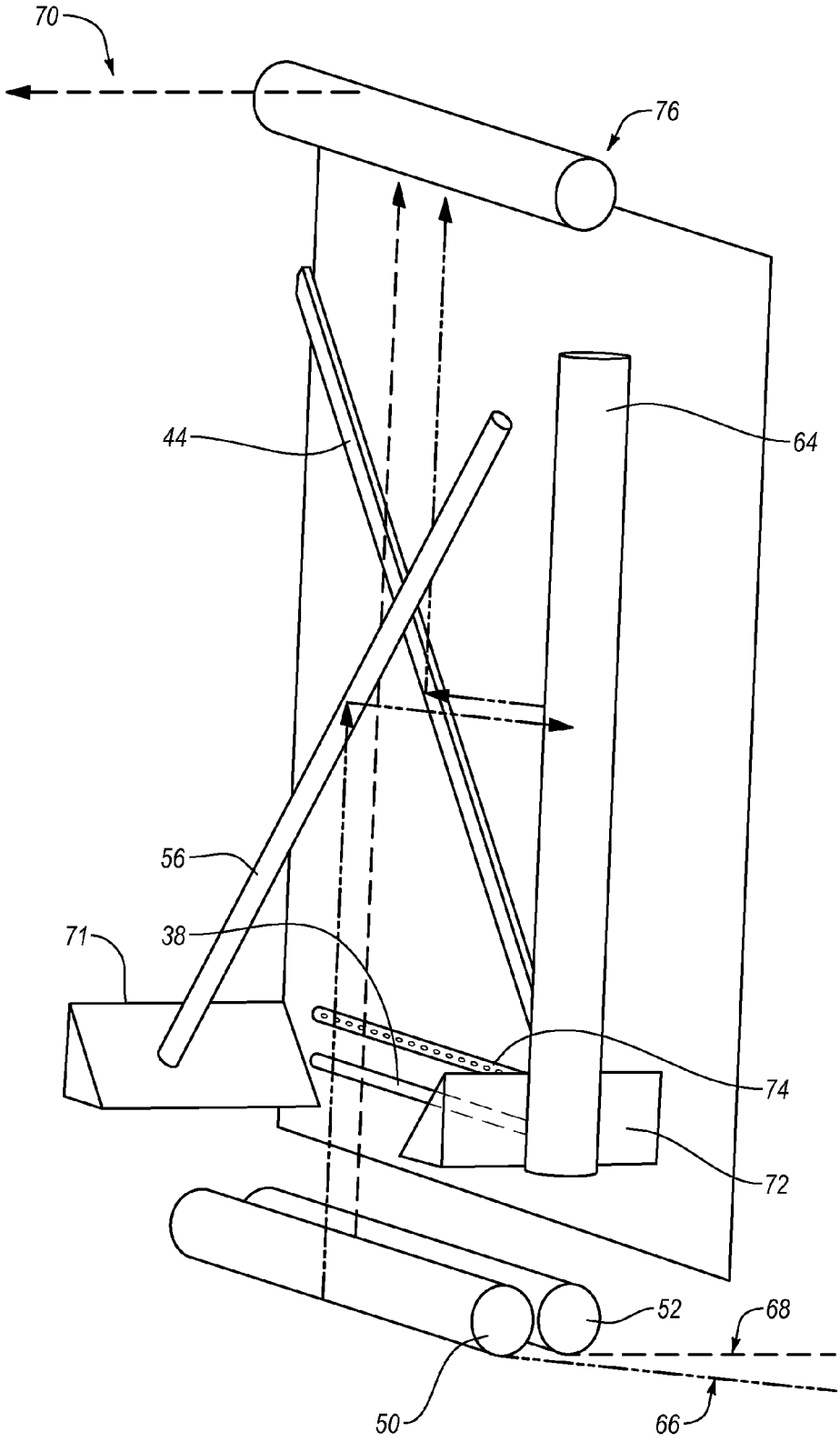
FIG. 3 illustrates particular components of an apparatus for insertion of a folded film into another folded film in accordance with an implementation of the present invention.

FIG. 3 illustrates another implementation of an apparatus for inserting a first folded film within a second folded film. The apparatus of FIG. 3 is similar to that of FIG. 2 albeit positioned vertically. One will appreciate in light of the disclosure herein that the vertical orientation of the apparatus of FIG. 3 can further reduce the footprint of the apparatus and save manufacturing space. As shown by FIG. 3, in one or more implementations the spreader bar 38 direction change bar 44, guide roller 52, and orientation roller 64 are positioned in the same vertical plane. The direction change bar 44 and guide roller 50 are positioned in a second vertical plane horizontally offset from the first vertical plane.

FIG. 3 omits folded film 10 and folded film 20 in order to make the depicted components more readily visible and understandable. Line 66 illustrates the path of folded film 10 and line 68 illustrates the path of folded film 20. Line 70 on the other hand illustrates the path of multi-layer composite folded film 30.

FIG. 3 illustrates guide rollers 50 and 52 which receive folded film 10 and folded film 20, respectively. Guide roller 50 can direct folded film 10 along path 66 to direction change bar 56. Guide roller 60 can direct folded film 20 along path 68 to spreader bar 38. The apparatus can further include supports or posts 71, 72 which support one or more of the rollers or bars 38, 44, 56, 74. For example, FIG. 3 illustrates that post 71 can support direction change bar 56. Similarly, post 72 can support spreader bar 38, direction change bar 44, and applicator 74.

As previously alluded, one or more implementations can include an applicator positioned between spreader bar 38 and direction second change bar 38. For example, FIG. 3 illustrates an applicator 74 positioned in line and between spreader bar 38 and direction change bar 44. Similar to the integrated applicator in the spreader bar of FIG. 1, the applicator 74 can apply an additive to one or more of the halves 16, 18, 26, 28 of the folded films 10, 20. Such additives can comprise glues, adhesives, oils, fragrances, or other additives. For example, in one or more implementations the applicator can apply glue or another adhesive to the inner surface of the folded film 20. The glue can then adhere or laminate the inner surface of the folded film 20 to the outer surface of the folded film 10 after the folded film 10 is inserted within the folded film 20.

In alternative implementations, the apparatus can include one or more applicators that apply an additive to the folded film 10. For example, a pair of applicators can extend above and below the folded film 10 and spray an additive on the outer surface of the folded film 10. In one or more implementations the apparatus can include such applicators between the orientation roller 64 and direction change bar 44.

As illustrated by FIGS. 1-3, it is possible that one or more implementations of the present invention may comprise some, all, or additional components as depicted in FIGS. 1-3. For example, FIG. 3 illustrates that orientation roller 60 may be omitted. In particular, orientation roller 64 can receive the folded film 10 after the folded film 10 leaves the direction change bar 56. Orientation roller 64 can then direct folded film to direction change bar 44.

In yet additional implementations, one or more orientation rollers and direction change bars can transition folded film 20 to the same plane as folded film 10. This is in contrast to FIG. 2 which shows one or more orientation rollers and direction change bars transitioning folded film 10 to the same plane as folded film 20. Such variations and alternative configurations are consistent with and are contemplated by the present invention. Further, such alternative configurations can accommodate various sizes of apparatus conforming to the present invention and accommodate the apparatus and/or process being employed in distinct and various situations. Accordingly, the components and descriptions herein should not be read as limitations and all variations and embodiments consistent with this description shall be considered within the scope of the invention.

One will appreciate in light of the disclosure herein that the multi-layer composite folded film can form part of any type of product made from, or incorporating, thermoplastic films. For instance, grocery bags, trash bags, sacks, packaging materials, feminine hygiene products, baby diapers, adult incontinence products, sanitary napkins, bandages, food storage bags, food storage containers, thermal heat wraps, facial masks, wipes, hard surface cleaners, and many other products can include multi-layer composite folded film. By inserting one folded film into another folded film, a multi-layer composite folded film may be produced which comprises the beneficial but possibly distinct properties of each of the folded films of the multi-layer composite folded film. Trash bags and food storage bags may be particularly benefited by the multi-layer composite folded film of the present invention.

Figure 4A:
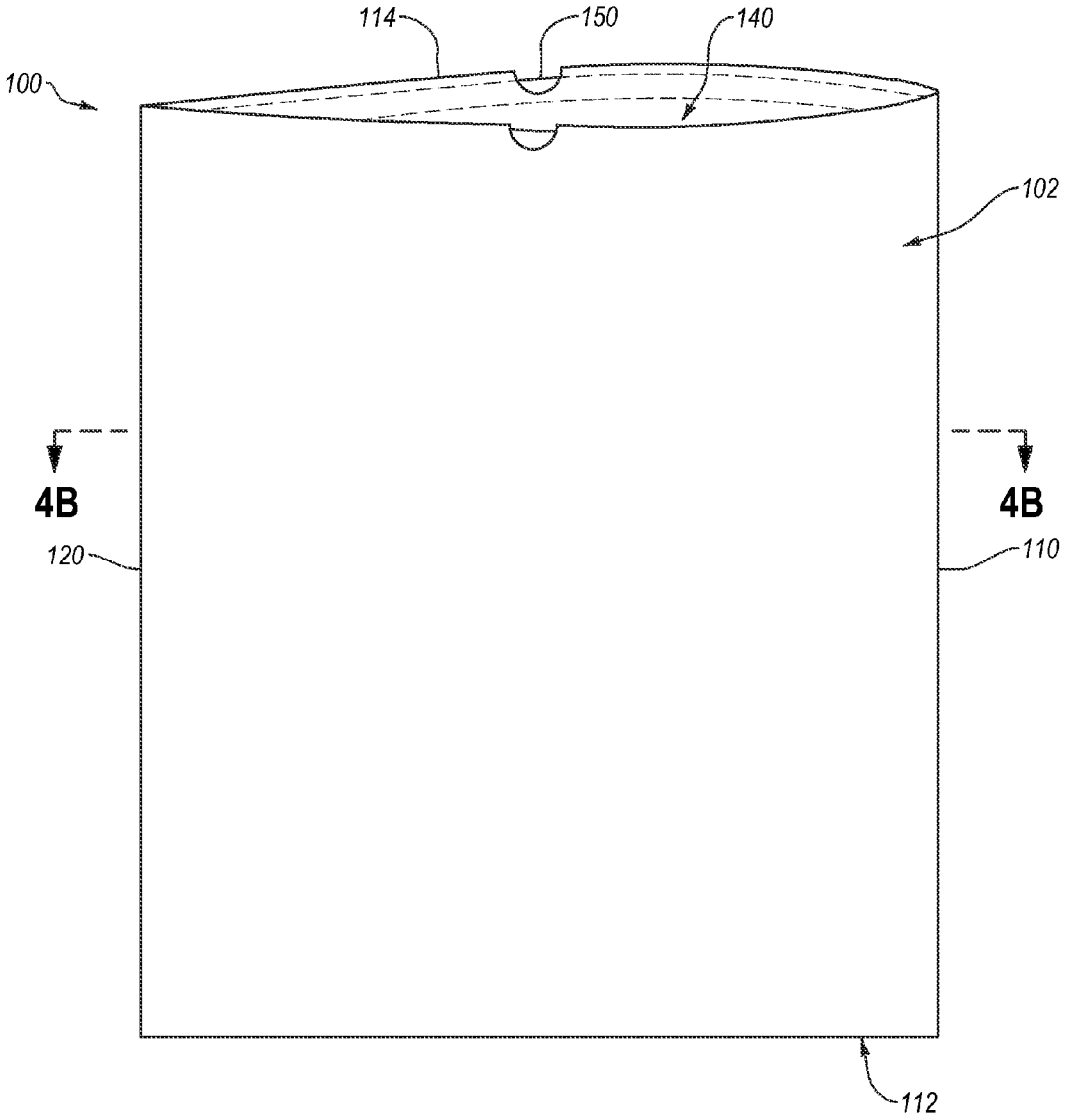
FIG. 4A illustrates a bag incorporating a multi-layer composite folded film in accordance with one or more implementations of the present invention.

Referring to FIG. 4A, in a particular implementation of the present invention, the multi-layer composite folded film 30 as illustrated in FIG. 1 may be incorporated in a bag construction. The bag 100 can include a bag body 102 formed from a piece of a multi-layer composite folded film. The bag bottom 112 can coincide with the folded edge 32 of the multi-layer composite of folded films. Side seams 110 and 120 can bond the sides of the bag body 102 together to form a semi-enclosed container having an opening 140 along an open edge 114 (which corresponds to open edge 34 of multi-layer composite folded film 30). The bag 100 also optionally includes closure means 150 located adjacent to the open edge 114 for sealing the top of the bag to form a fully-enclosed container or vessel. The bag 100 is suitable for containing and protecting a wide variety of materials and/or objects. The closure means 150 can comprise flaps, adhesive tapes, a tuck and fold closure, an interlocking closure, a slider closure, a zipper closure or other closure structures known to those skilled in the art for closing a bag.

Figure 4B:
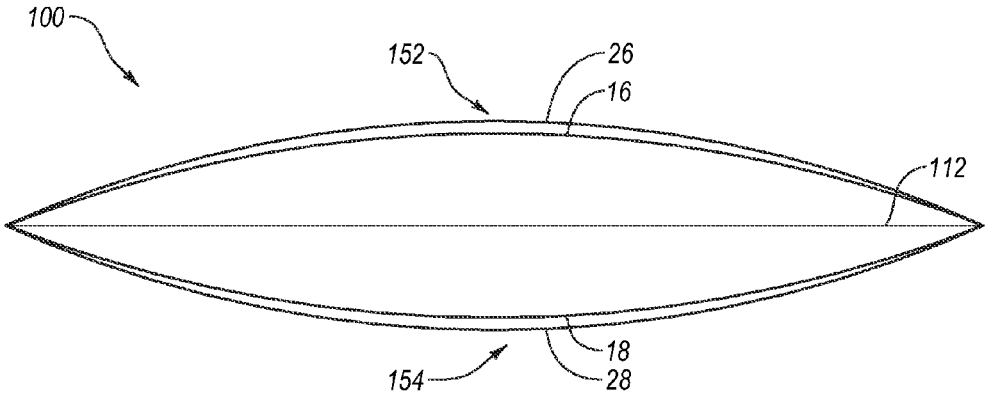
FIG. 4B illustrates a cross-sectional view of the bag of FIG. 4A taken along the line 4A-4A of FIG. 4A.

As shown by FIG. 4B, first halves 16, 26 of folded films 10, 20 can form a first side wall 152. Second halves 18, 28 of folded films 10, 20 can form a second side wall 154. Seals can join the edges of first halves 16, 26 and second halves 18, 28 adjacent the bag bottom (i.e., folded edge 32). The composition of the properties of the folded films 10, 20 in a bag created from multi-layer composite folded film 30 may increase tear and impact resistance and can help prevent a bag created from multi-layer composite folded film 30 from tearing and losing the contents therein.

Figure 5:
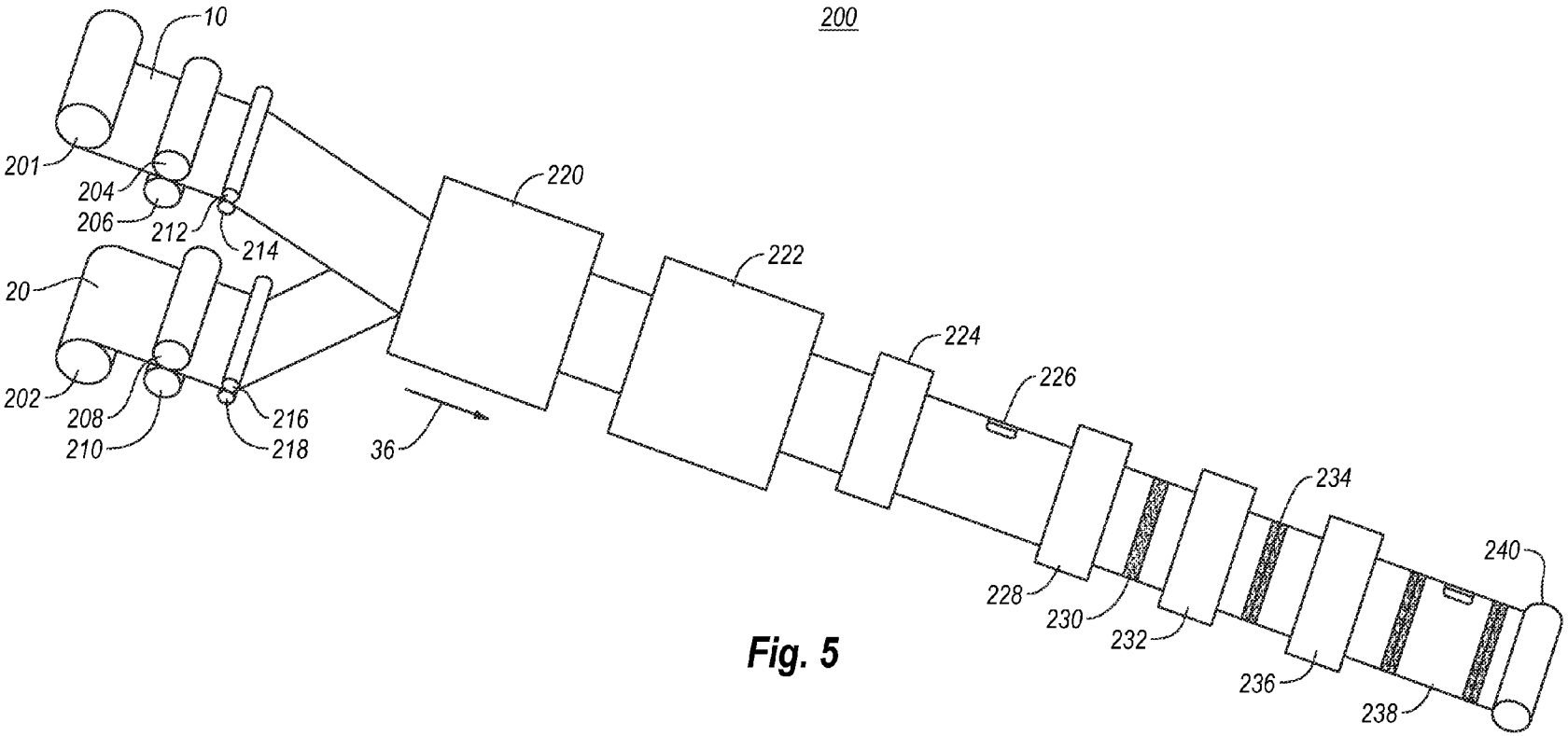
FIG. 5 illustrates a schematic diagram of a bag manufacturing process in accordance with one or more implementations of the present invention.

FIG. 5 illustrates an exemplary embodiment of a manufacturing process 200 for inserting a folded film into another folded film and producing a plastic bag there from. According to the process, folded film 10 is unwound from a roll 201 and directed along a direction of travel 36. Direction of travel 36 may be along the machine direction. A second folded film 20 is unwound from a roll 202 and directed along direction of travel 36.

Folded film 10 can optionally pass between first and second intermeshing rollers 204, 206 to incrementally stretch the folded film 10. Similarly, folded film 20 can optionally pass between third and fourth intermeshing rollers 208, 210. Incrementally stretching the folded films 10, 20 can modify and/or increase one or more of the physical properties of the folded films 10, 20 and/or increase the surface area of the folded films 10, 20 and/or reduce the gauge of the folded films 10, 20. Furthermore, incrementally stretching the folded films 10, 20 can provide the folded films 10, 20 with a visual pattern that can serve to notify a consumer that the folded film 10 has been processed to enhance one or more properties.

The intermeshing rollers 204, 206, 208, 210 can be machine-direction ring rolls, transverse-direction ring rolls, diagonal-direction ring rolls, structural elastic like film (SELF) rollers, embossing rollers, or other intermeshing rollers. The intermeshing rollers 204, 206, 208, 210 may be arranged so that their longitudinal axes are perpendicular to the machine direction. Additionally, the intermeshing rollers 204, 206, 208, 210 may rotate about their longitudinal axes in opposite rotational directions. In various embodiments, motors may be provided that power rotation of the intermeshing rollers 204, 206, 208, 210 in a controlled manner. As the folded films 10, 20 pass between the intermeshing rollers 204, 206, 208, 210, ridges and/or teeth of the intermeshing rollers 204, 206, 208, 210 can stretch the folded films 10, 20.

A number of U.S. patents have issued for incrementally stretching thermoplastic films and laminates. An early example of the patent art which discloses a method of incrementally stretching film is U.S. Pat. No. 5,296,184. Other relevant patents regarding the incremental stretching of thermoplastic films and laminates include U.S. Pats. Nos. 6,265,045; 6,214,147; 6,013,151; 5,865,926; 5,861,074; 5,851,937; 5,422,172; 5,382,461; 5,518,801, 6,139,185; 6,150,647; 6,394,651; 6,394,652; 6,513,975; 6,695,476; and U.S. Patent Application Publication Nos. 2004/0134923 and 2006/0093766. Each of the forgoing patents and patent applications are hereby incorporated by reference in their entirety.

Additionally, or alternatively, to incremental stretching, the process 200 can include orienting the folded films 10, 20, For example, the process 200 can include machine direction orient (MDO) the folded films by passing them between two pairs of smooth rollers. The nip of the first pair of rollers, which are running at a relatively slow speed, can pinch the folded film 10, 20. The nip of a second pair of rollers downstream from the first pair, which are operating faster than the first pair, and then pinch the folded film 10, 20. Because of the difference in run speeds, the film in between the roller pairs must either stretch or break to accommodate the difference.

The ratio of the roller speeds will roughly determine the amount that the film is stretched. For example, if the first pair is running at 100 feet per minute (fpm) and the second pair is running at 300 fpm, the film will be stretched to roughly three times it original length. The MDO method stretches the film continuously in the machine direction (MD) only. The MDO stretching method is used to create an MD oriented film. Optionally, the process 200 can include tentering the fold films 10, 20. In simplest terms, the tentering method involves grabbing the sides of the film and stretching it sideways.

In any event, one will appreciate in light of the disclosure herein that one or more implementations of a process and apparatus for inserting a folded film within another folded film can allow independent stretching or orientation of the folded films 10, 20. Thus, the process 200 can include stretching or orientation of the folded film 10 to a differing degree or using a different technique than the stretching or orientation of the folded film 20. The combination of films of different orientations and/or type or degree of stretching can allow for a rebalance or other modification of film properties. In one or more implementations, the resulting properties of the multi-layer composite folded film 30 may be additive or otherwise enhanced based on differing properties of each of the folded films 10, 20.

During the manufacturing process 200, the folded films 10, 20 can also pass through pairs of pinch rollers 212, 214, 216, 218. The pinch rollers 212, 214, 216, 218 can be appropriately arranged to grasp the folded films 10, 20. The pinch rollers 212, 214, 216, 218 may facilitate and accommodate the folded films 10, 20.

Next an insertion operation 220 can inserting the folded film 10 into the folded film 20. Insertion operation 220 can combine the folded films 10, 20 using any of the apparatus and methods described herein above in relation to FIGS. 1-3. In one or more implementations the insertion operation 220 can also laminate the folded films together 10, 20 (i.e., when the insertion operation 220 includes an applicator that applies a glue or other adhesive to one or more of the folded films 10, 20).

Alternatively, the process 200 can include a separate lamination operation 222. Lamination operation 222 can continuously or discontinuously laminate the folded films 10, 20 together. As a verb, "laminate" means to affix or adhere (by means of, for example, adhesive bonding, pressure bonding, ultrasonic bonding, corona lamination, and the like) two or more separately made film articles to one another so as to form a multi-layer structure; as a noun, "laminate" means a product produced by the affixing or adhering just described. Thus, in one or more implementations, lamination operation 222 can include laminating folded films 10, 20 together by passing them through machine-direction ring rolls, transverse-direction ring rolls, diagonal-direction ring rolls, SELF'ing rollers, embossing rollers, or other intermeshing rollers.

To produce a finished bag, the processing equipment may further process the multi-layer composite folded film 30 after it emerges from the insertion and/or lamination operations 220, 222. In particular, a draw tape operation 224 can insert a draw tape 226 into the composite folded film 30 at the open edge 34. Furthermore, a sealing operation 228 can form the parallel side edges of the finished bag by forming heat seals 230 between adjacent portions of the multi-layer composite folded film 30. The heat seals 230 may be incrementally spaced apart along the multi-layer composite folded film 30. The sealing operation 228 can form the heat seals 230 using a heating device, such as, a heated knife.

A perforating operation 232 may form a perforation 234 in the heat seals 230 using a perforating device, such as, a perforating knife. The perforations 234 in conjunction with the folded edge 32 can define individual bags 238 that may be separated from the modified composite folded film 30. A roll or spool 240 can wind the modified composite folded film 30 embodying the finished bags 238 for packaging and distribution. For example, the roll 240 may be placed into a box or bag for sale to a customer.

In still further implementations, the multi-layer composite folded film 30 may be cut into individual bags along the heat seals 230 by a cutting operation 236. In another implementation, the multi-layer composite folded film 30 may be folded one or more times prior to the cutting operation 236. In yet another implementation, the side sealing operation 228 may be combined with the cutting and/or perforation operations 232, 236.

One will appreciate in light of the disclosure herein that the process 200 described in relation to FIG. 5 can be modified to omit or expanded acts, or vary the order of the various acts as desired. For example, two or more separate films or folded films can be inserted within the folded film 20 during the insertion operation 220. In one or more additional implementations the folded films 10, 20 may not be oriented or stretched. In yet additional implementations, the multi-layer composite folded film 30 may be oriented or stretched.

Implementations of the present invention can also include methods of inserting a folded film within another folded film. The following describes at least one implementation of a method with reference to the components and diagrams of FIGS. 1 through 5. Of course, as a preliminary matter, one of ordinary skill in the art will recognize that the methods explained in detail herein can be modified to install a wide variety of configurations using one or more components of the present invention. For example, various acts of the method described can be omitted or expanded, and the order of the various acts of the method described can be altered as desired.

For example, one method in accordance with one or more implementations of the present invention can involve advancing a folded film 20 a first direction of travel 36 in a first plane. The method can also involve advancing another folded film 10 in the first direction of travel 36 in a second plane. The first and second planes may be vertical planes that are offset or horizontal planes that are vertically offset.

The method can further involve redirecting the folded film 10 from the first plane to the second plane. For example, the method can involve redirecting the folded film 10 from the first direction of travel 36 to another direction of travel 54 that is perpendicular to the first direction of travel 36. In particular, the method can involve passing the folded film 10 about a direction change bar 56. The method can then involve passing the folded film 10 about one or more orientation rollers 60, 64 that redirect the folded film from the first plane to the second plane and from the direction of travel 54 to a direction of travel 42 that is opposite the direction of travel 54.

The method can additionally involve separating the halves of the folded film 20. For example, the method can involve passing the folded film 20 about a spreader bar 38. In particular, a first half 26 can pass on one side of the spreader bar 38 while a second half 28 of the folded film 20 passes on an opposing side of the spreader bar 38. Optionally, the method can further involve directing an additive out of the spreader bar 38 and onto the folded film 20.

The method can further involve inserting the folded film 10 into the folded film 20. For example, the method can involve advancing the folded film 10 between the first half 26 and the second half 28 of the folded film 20. The method can also involve redirecting the folded film 10 from the direction of travel 42 to the direction of travel 38 while between the first half 26 and the second half 28 of the folded film 20. For instance, the method can involve passing the folded film 10 about a direction change bar 44 situated between the first half 26 and the second half 28 of the folded film 20.

Accordingly, FIGS. 1-5 and the corresponding text, therefore, specifically show, describe, or otherwise provide a number of systems, components, apparatus, and methods for inserting a folded film into another folded film to create a multi-layer composite folded film. These apparatus and methods can insert a folded film into another folded film to create a multi-layer composite folded film which has the beneficial effects of the properties of both folded films.

There are several advantages associated a multi-layer composite folded film created in accordance with one or more implementations of the present invention. The methods and apparatus described herein allow for independent cold formation of each folded film or ply. The methods and apparatus described herein result in conservation of floor space in manufacturing thereby resulting in lowered capital costs. The methods and apparatus described herein disclose a simpler process design than previously available resulting in better reliability, and less wrinkles in the resulting product(s) due to a reduction in the process steps required since individual folding and unfolding of webs is not required. As the methods and apparatus described herein may decrease the time and complexity for inserting a folded film into another folded film, manufacturers can decrease the cost of their products if they use the one or more of the methods and apparatus described herein. These cost savings may be significant.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. An apparatus for inserting a second folded film into a first folded film, the apparatus comprising:

a first roll positioned on a first horizontal plane;

a second roll positioned on a second horizontal plane vertically offset from the first horizontal plane;

a spreader bar extending in a first direction;

one or more orientation rollers extending in a second direction that is transverse to the first direction; and a first direction change bar positioned down line relative to the spreader bar, the first direction change bar extending in a third direction that is oriented at an acute angle relative to the first direction.

2. The apparatus as recited in claim 1, further comprising a second direction change bar positioned out of plane with the first direction change bar.

3. The apparatus as recited in claim 2, wherein the second direction change bar extends in a fourth direction that is transverse to the third direction.

4. The apparatus as recited in claim 2, further comprising one or more additional orientation rollers positioned in plane with the second direction change bar.

5. The apparatus as recited in claim 4, wherein the one or more additional orientation rollers extend in the second direction.

6. The apparatus as recited in claim 4, wherein:

the spreader bar, the one or more orientation rollers, and the first direction change bar are positioned in a first vertical plane;

the first direction change bar is positioned vertically above the spreader bar; and the second direction change bar and the one or more additional orientation rollers are positioned in a second vertical plane that is horizontally offset from the first vertical plane.

7. The apparatus as recited in claim 1, further comprising:

an applicator positioned between the spreader bar and the first direction change bar;

the applicator being configured to dispense one or more additives.

8. The apparatus as recited in claim 1, wherein the spreader bar is configured to dispense one or more additives.

9. The apparatus as recited in claim 6, wherein one or more of the first direction change bar and the second direction change bar comprise an air bearing.

10. An apparatus for inserting a second folded film into a first folded film, the apparatus comprising:

one or more rollers configured to direct the first folded film in a vertical direction of travel;

one or more additional rollers configured to direct the second folded film in the vertical direction of travel;

a spreader bar configured to separate layers of the first folded film;

at least one orientation roller configured to direct the second folded film in a horizontal direction of travel between the separated layers of the first folded film; and a first direction change bar configured to change a direction of travel of the second folded film from the horizontal direction of travel to the vertical direction of travel while the second folded film is positioned between the layers of the first folded film.

11. The apparatus as recited in claim 10, wherein the spreader bar and the first direction change bar are positioned in a first plane.

12. The apparatus as recited in claim 11, wherein the first plane is a vertical plane, and the first direction change bar is positioned vertically above the spreader bar.

13. The apparatus as recited in claim 10, further comprising an applicator configured to apply one or more additives to one or more of the first folded film or the second folded film.

14. The apparatus as recited in claim 13, wherein the applicator is integrated in the spreader bar.

15. The apparatus as recited in claim 13, wherein the applicator is positioned between the spreader bar and the first direction change bar.

16. The apparatus as recited in claim 11, further comprising a second direction change bar configured to change the direction of travel of the second folded film from the vertical direction of travel to the horizontal direction of travel.

17. The apparatus as recited in claim 16, wherein one or more of the first direction change bar and the second direction change bar comprise an air bearing.

18. The apparatus as recited in claim 17, further comprising:

a first roll positioned on a first horizontal plane, the first folded film being configured to be unwound from the first roll;

a second roll positioned on a second horizontal plane vertically offset from the first horizontal plane, the second folded film being configured to be unwound from the second roll.

19. An apparatus for inserting a second folded film into a first folded film, the apparatus comprising:

a spreader bar extending in a first direction and in a first plane, the spreader bar being configured to separate layers of the first folded film;

one or more rollers configured to direct the first folded film across the spreader bar in a vertical direction of travel;

one or more orientation rollers extending in a second direction that is perpendicular to the first direction, the one or more orientation rollers being configured to direct the second folded film between the separated layers of the first folded film in a horizontal direction of travel; and a first direction change bar, wherein the first direction change bar:

extends in a third direction that is oriented at an acute angle relative to the first direction, includes an air bearing, and is configured to redirect the second folded film from the horizontal direction of travel to the vertical direction of travel while the second folded film is positioned between the layers of the first folded film.

20. The apparatus as recited in claim 19, further comprising:

one or more additional rollers configured to direct the second folded film in the vertical direction of travel in a second plane offset from the first plane;

a second direction change bar, wherein the second direction change bar is:

extending in a fourth direction that is oriented perpendicularly to the third direction, and configured to redirect the second film from the vertical direction of travel to the horizontal direction of travel while in the second plane; and one or more additional orientation rollers configured to direct the second film from the second plane to the first plane.

* * * * *